US006453148B1

(12) United States Patent
Friedrich et al.

(10) Patent No.: US 6,453,148 B1
(45) Date of Patent: Sep. 17, 2002

(54) APPARATUS AND PROCESS FOR DETECTING LEAKS IN AN ELECTROGRAPHIC CLEANING SYSTEM

(75) Inventors: Kenneth P. Friedrich, Honeoye; Kurt E. Jones, Webster; Philip A. Stern, Spencerport, all of NY (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/732,505

(22) Filed: Dec. 7, 2000

(51) Int. Cl.[7] ..... G03G 21/00; G03G 15/00

(52) U.S. Cl. ..... 399/358; 399/99; 399/120; 399/360

(58) Field of Search ..... 399/91, 92, 99, 399/107, 123, 358, 359, 360, 262, 34, 35, 120; 222/DIG. 1; 73/49.2

(56) References Cited

U.S. PATENT DOCUMENTS 5,521,690 A * 5/1996 Taffler et al. ..... 399/262

* cited by examiner

*Primary Examiner*—Sophia S. Chen
*Assistant Examiner*—Hgang Ngo
(74) *Attorney, Agent, or Firm*—Kevin L. Leffel

(57) ABSTRACT

The invention relates to cleaning systems for electrographic processes and, in particular, to detecting leaks in such processes. A process and apparatus for sensing leaks is provided in an electrographic process cleaning system of the type configured to have a particle collection container. According to an aspect of the invention, a pressure is sensed that is indicative of pressure inside the particle collection container.

20 Claims, 4 Drawing Sheets

APPARATUS AND PROCESS FOR DETECTING LEAKS IN AN ELECTROGRAPHIC CLEANING SYSTEM

BACKGROUND

The invention relates to cleaning systems for electrographic processes and, in particular, to detecting leaks in such processes.

Electrographic printing processes commonly implement cleaning systems in order to remove waste products from the process. In a process that implements particles for development, such as a dry toner, vacuum cleaning is often implemented with a particle separator that separates waste particles from a cleaning gas flow. The particles are deposited in a particle collection container for subsequent disposal. Leaks in the cleaning system may inhibit performance and have other undesirable effects, including the deposit of waste particles in undesirable places.

SUMMARY

According to an aspect of the invention, a process and apparatus for sensing leaks is provided in an electrographic process cleaning system of the type configured to have a particle collection container comprising sensing a pressure inside the particle collection system proximate the particle collection container.

According to a further aspect of the invention, a process and apparatus is provided for sensing leaks in a particle collection container that collects particles from an electrographic process comprising sensing a pressure indicative of pressure inside the particle collection container.

According to a still further aspect of the invention an apparatus is provided for removing particles from an electrographic process, comprising a particle separator, a particle collection container in fluid communication with the particle separator, a vacuum source in fluid communication with the particle separator, and a pressure sensor in fluid communication with the particle collection container wherein the pressure sensor senses the presence of leaks in the particle collection container.

DETAILED DESCRIPTION

Various aspects of the invention are presented in FIGS. 1–6, which are not drawn to scale and wherein like components in the numerous views are numbered like. The various components presented and described with reference to the Figures may be altered or substituted with other types of components suitable for use within an electrographic cleaning process, as may be desired for a particular application, without departing from the invention. It is not intended to limit the invention to the specific embodiments presented herein, as they are representative of the inventive concepts defined by the claims appended hereto.

Figure 1:
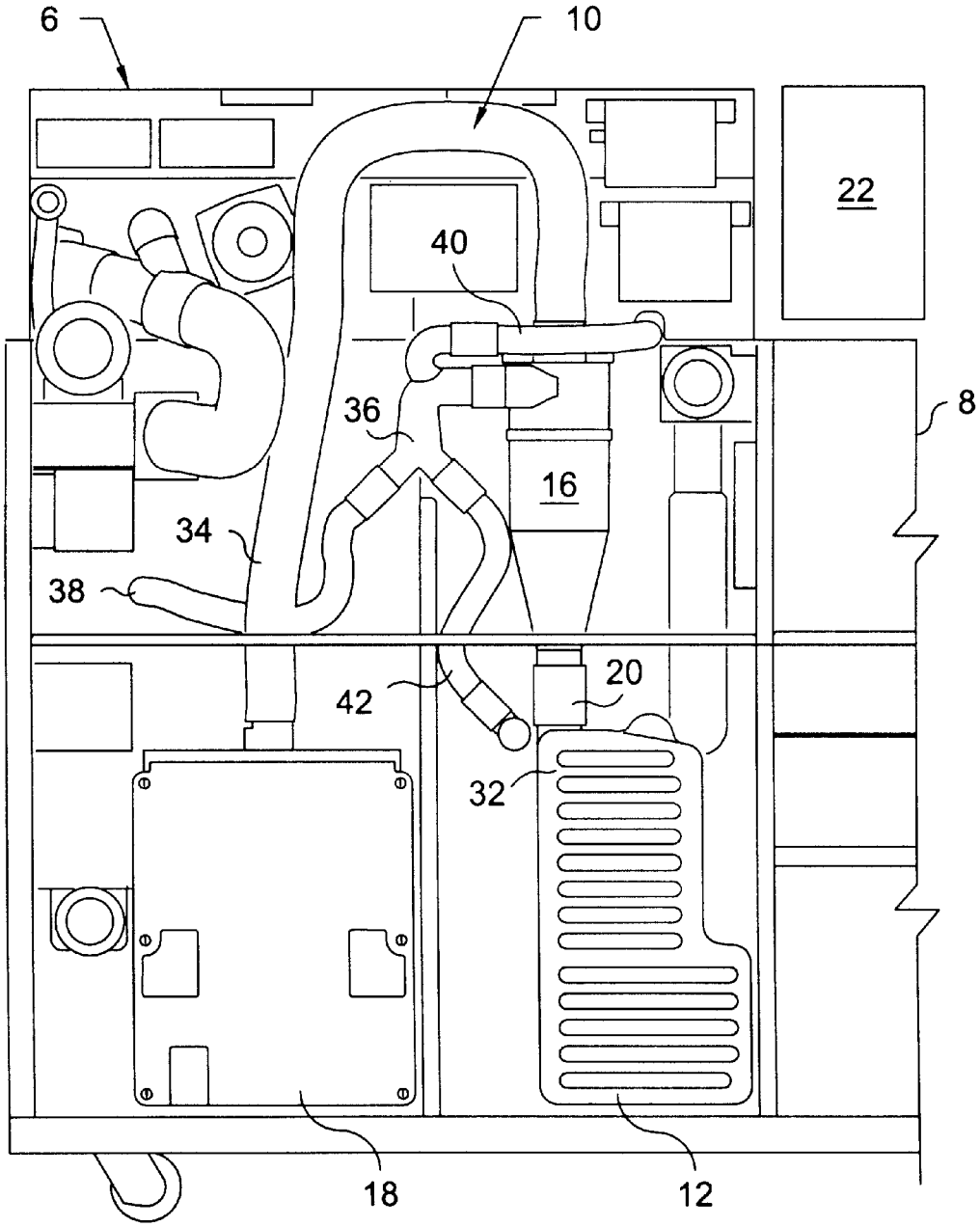
FIG. 1 presents a view of an electrographic marking engine, with parts broken away, having a cleaning system according to an aspect of the invention.

Referring now specifically to FIG. 1, an electrographic process cleaning system 10 is presented of the type configured to have a particle collection container 12. According to an aspect of the invention, a process for sensing leaks is provided comprising sensing a pressure inside the particle collection system 10 at a location 32 proximate the particle collection container 12 wherein the pressure is indicative of pressure inside the particle collection container 12 when the container 12 is present in the system 10. The pressure sensed need not be an actual pressure inside the particle collection container 12 in order to detect a leak.

A vacuum is imposed upon the cleaning system 10, by a vacuum source 18 for example, and according to a further aspect of the invention, the vacuum is terminated upon detection of a leak in the particle collection container 12. In the example presented, the vacuum source 18 also drives the flow of cleaning gas throughout the cleaning system 10. Leaks may develop due to a variety of sources, for example by cracking of the particle collection container 12, or the particle collection container 12 being omitted altogether. The latter may occur for testing or at a new installation, or due to a technician removing a full container 12 for emptying and omitting replacement of the container 12 into the cleaning system 10. Sensing an absence of the particle collection container 12 is included within an aspect of the invention.

Although not limited to a particular electrographic process, the invention is particularly useful in an electrographic process that implements a photoconductive film loop and dry toner development, also known as electrophotography. While the exemplary electrographic process cleaning system 10 presented in FIG. 1 is configured in a manner suitable for cleaning dry electrographic toner and paper particles in a film loop electrographic process, it is not intended to limit the invention in such manner. The cleaning system 10 is part of an electrographic marking engine 6, of which only a portion is shown, broken away at line 8.

The cleaning system 10 comprises a particle separator 16 in fluid communication with the particle collection container 12 via a conduit 20. The vacuum source 18 is in fluid communication with the particle separator 16 via a vacuum supply conduit 34. The particle separator 16 is also in fluid communication with a manifold 36 which, in turn, is in fluid communication with a film loop cleaning station (not shown) via a first conduit 38, a transfer roller cleaning station (not shown) via a second conduit 40, and a toning station dust collector (not shown) via a third conduit 42. The vacuum draws waste particles from the film loop cleaning station, transfer roller cleaning station, and the toning station dust collector through the conduits 38, 40 and 42, through the manifold 36, and into the particle separator 16 where the particles are separated from the flow and drop into the particle collection container 12. The vacuum source 18 draws the cleaned flow out of the particle separator 16 through conduit 34. The structure of the film loop cleaning station, transfer roller cleaning station, and toning station dust collector are known in the art. Such apparatus is provided in the Digimaster® 9110 brand digital high volume printer manufactured by Heidelberg Digital L.L.C. of Rochester, N.Y.

Figure 2:
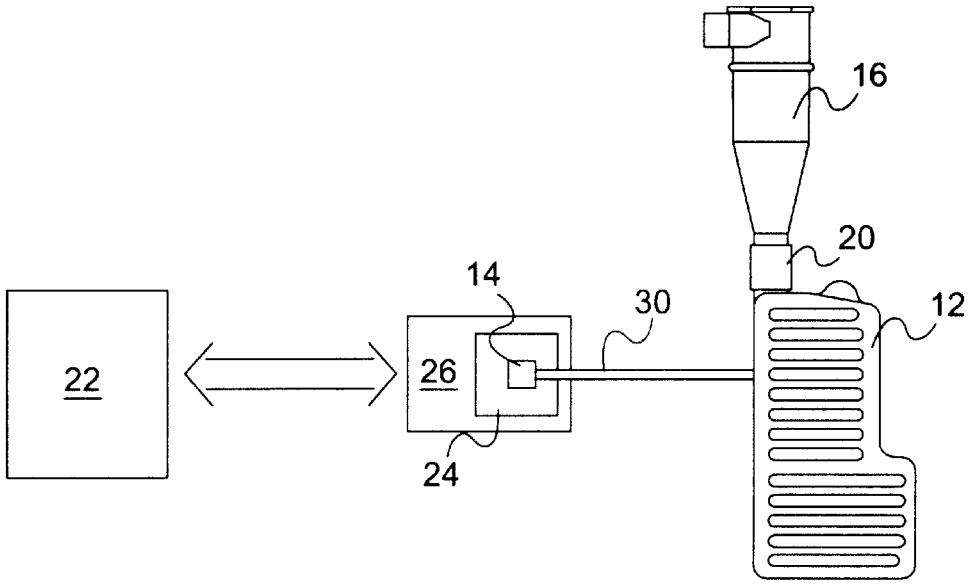
FIG. 2 presents a view of the particle separator and particle collection container of FIG. 1 with a pressure sensor installation according to a further aspect of the invention.
Figure 3:
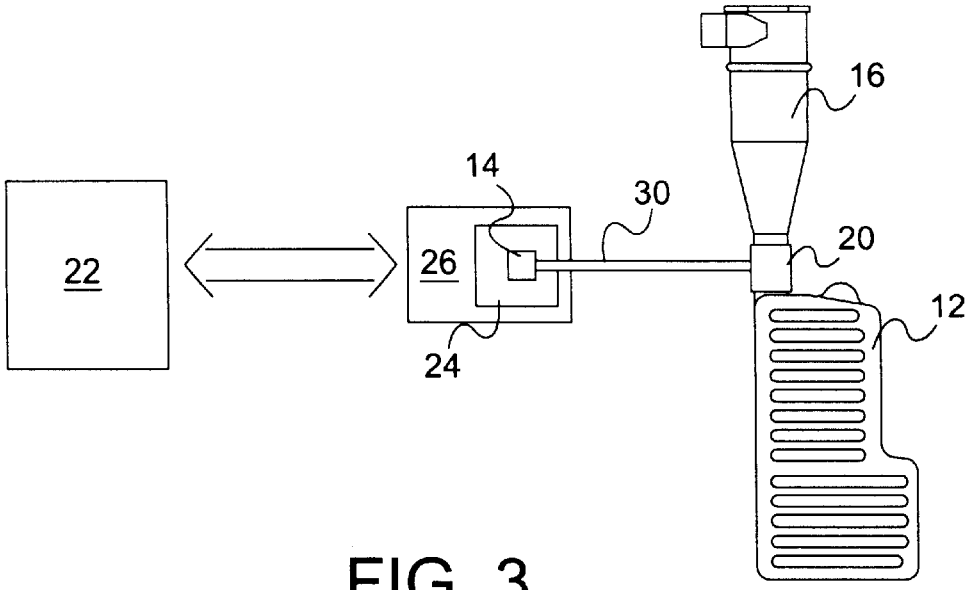
FIG. 3 presents a view of the particle separator and particle collection container of FIG. 1 with a pressure sensor installation according to a further aspect of the invention.

Referring now to FIG. 2, an embodiment according to a further aspect of the invention is presented. The particle separator 16 and particle collection container 12 are shown separated from the rest of the cleaning system 10 for the sake of clarity. In the embodiment of FIG. 2, a pressure sensor 14 is provided in fluid communication with the particle collection container 12 via a pressure sensor conduit 30 connecting the pressure sensor 14 and the particle collection container 12. The pressure sensor 14 senses a pressure inside the particle collection container 12. A leak is detected, for example, by an attendant increase in pressure sensed inside the particle collection container 12. The pressure sensor 14 is preferably located proximate the particle collection container, and pressure sensor support circuitry 24 is preferably located on a circuit board 26 in proximity with the pressure sensor 14. The pressure sensor 14 may also be located on the circuit board 26. Referring now to FIG. 3, an alternative embodiment is presented wherein the pressure sensor 14 is connected to the conduit 20. In either embodiment, the sensor conduit 30 is at a location wherein the sensed pressure is indicative of pressure inside the particle collection container 12 when the container 12 is present in the system 10.

Referring again to FIG. 1, the vacuum source 18 imposes a vacuum on the particle collection container 12. Experiments with a cleaning system of the type presented in FIG. 1 have demonstrated that a vacuum pressure inside a leaking particle collection container 12 is related to a quantity of particles collected in the particle collection container 12, and that the particles are drawn out of the particle collection container 12 upon the quantity exceeding a critical quantity having a corresponding critical sensed pressure. The vacuum is terminated upon the sensed pressure being greater than that of a non-leaking particle collection container 12 and less than the critical sensed pressure, thereby preventing the particles from being drawn out of the particle collection container 12. As used herein, the term "vacuum pressure" means a pressure less than ambient pressure outside the cleaning system 10.

Figure 4:
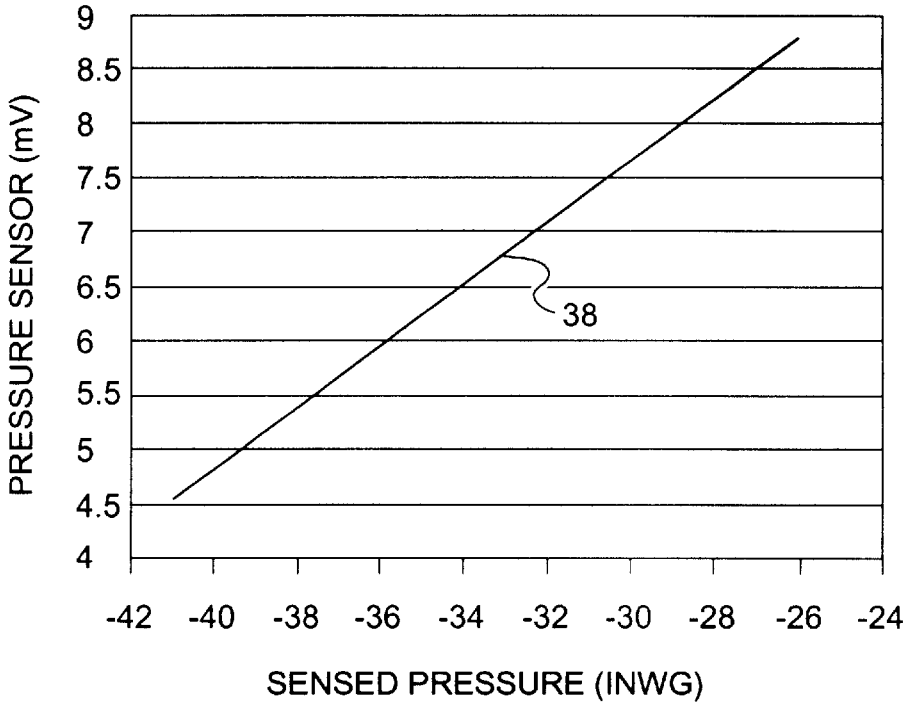
FIG. 4 presents a plot of pressure sensor output versus sensed pressure for a pressure sensor implemented in a certain preferred embodiment.
Figure 5:
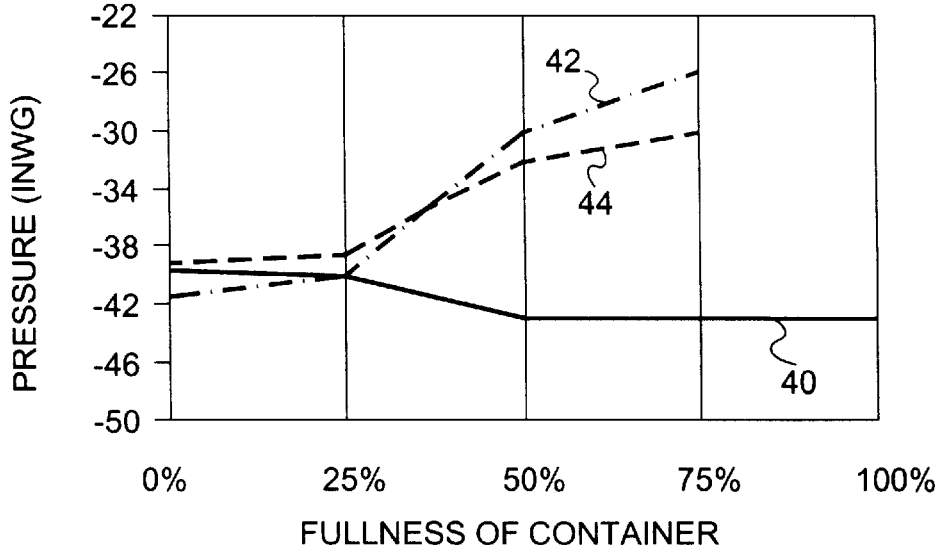
FIG. 5 presents a plot of sensed pressure versus fullness of the particle collection container using the pressure sensor of FIG. 4 in a certain preferred embodiment.

As an example, reference is now made to FIGS. 4 and 5 presenting results from experimentation of the electrographic process cleaning system 10 having a vacuum blower as vacuum source 18 available from Ametek Division of Rotron, Kent, Ohio, U.S.A., a particle separator 16 configured as a cyclone separator of the type described in U.S. Pat. Nos. 4,724,459 and 5,899,600 and a waste toner collection bottle as particle collection container 12 having a volume of about 63 cubic inches. The waste toner collection bottle 12 is formed from conductive plastic and connected by a ground strap to the marking engine frame for safety purposes. The pressure sensor 14 was a solid-state pressure sensor element, catalogue number SCC05DG2, available from SenSym Inc. of California, U.S.A., and was connected to the particle collection container 12 via pressure sensor conduit 30 (as previously described with reference to FIG. 2). Referring specifically to FIG. 4, pressure sensor calibration is presented showing pressure sensor output in mV (millivolts) versus sensed pressure in inches of water, gage, with an empty particle collection container 12, indicated by line 38.

Referring now to FIG. 5, sensed pressure in inches of water, gage, versus fullness in percent (%) of the particle collection container 12 is presented for a non-leaking container, indicated by line 40, and for a leaking container, indicated by lines 42 and 44. In FIGS. 4 and 5, a negative pressure indicates vacuum, and zero (0) inches of water, gage, represents ambient pressure. The container 12 in these tests leaked to due a crack located in the bottom of the container 12.

Note that up to a fullness of about 25%, the sensed pressure for the leaking and non-leaking containers 12 are approximately the same. As fullness increases, the sensed pressure for the leaking container 12 increases substantially. Tests have shown that particles were not drawn out of the leaking particle collection container 12 until the container is approximately 75% full, although this may not always be the case depending upon the particular configuration of cleaning system 10. At about that fullness, the vacuum source 18 begins to draw particles out of the container 12 and the process continues until the container is empty: also referred to herein as blow-out. Thus, according to an aspect of the invention, vacuum is terminated upon the sensed pressure being greater than that for a non-leaking container 12 (line 40), and less than the pressure at which blow-out begins (lines 42 and 44), which is about 28 inches of water, gage, in the specific example presented herein. According to a preferred embodiment, the vacuum is terminated when sensed pressure rises to between 30 and 38 inches of water, gage, inclusive corresponding to a fullness of approximately 50% (25% less than the critical fullness). In some systems, blow-out may not occur.

Figure 6:
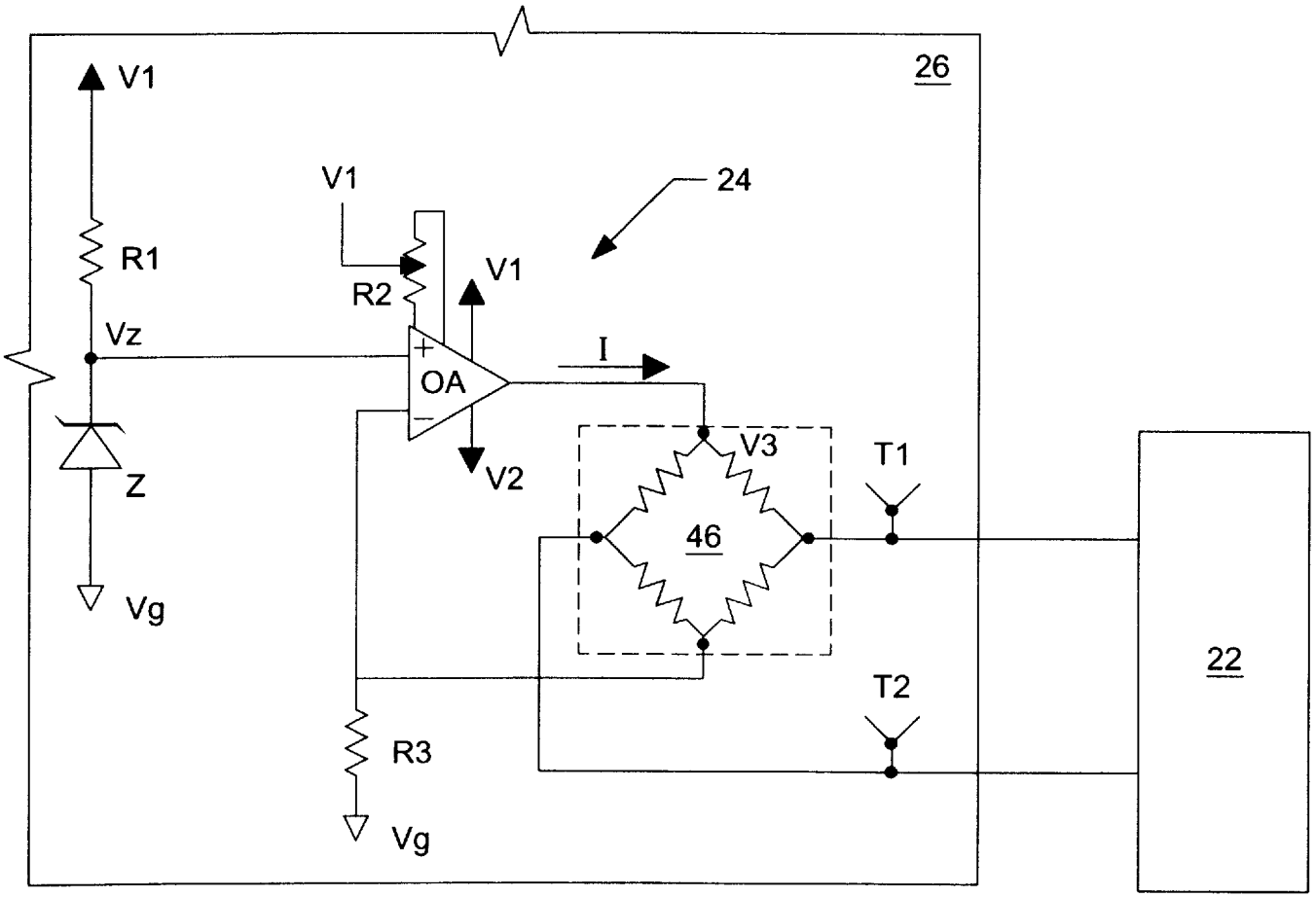
FIG. 6 presents an electrical schematic of an embodiment of pressure sensor support circuitry implemented in combination with a controller according to an aspect of the invention.

Referring now to FIG. 6, a detailed example of the pressure sensor support circuitry 24 is presented suitable for use with the SCC05DG2 solid-state pressure sensor element previously disclosed herein. The SCC05DG2 pressure sensor (shown in phantom) comprises a wheatstone bridge 46, as is known in the transducer art. The solid-state pressure sensor support circuit 24 is powered by voltages V1 and V2, for example +15 VDC and −15 VDC, respectively, relative to a lower potential, Vg, preferably system ground. A regulated voltage Vz is produced by a zener diode Z (2.7 volt, for example), a current limited by resistor R1 (1 kΩ 1% metal film, for example). An operational amplifier OA generates a constant current I equal to Vz/R3, which supplies the wheatstone bridge 46 (R3 may be a 2.8 kΩ 1% metal film resistor, for example, producing a current less than or equal to 1 mA). A variable resistor R2 is provided for offset adjustment. A pair of test points T1 and T2 may also be provided. As shown in FIGS. 1, 2, 3 and 6, a controller 22 preferably performs the logic and control aspects of the invention.

Although the invention has been described and illustrated with reference to specific illustrative embodiments thereof, it is not intended that the invention be limited to those illustrative embodiments. Those skilled in the art will recognize that variations and modifications can be made without departing from the true scope and spirit of the invention as defined by the claims that follow. It is therefore intended to include within the invention all such variations and modifications as fall within the scope of the appended claims and equivalents thereof.

We claim:

1. A process for sensing leaks in an electrographic process cleaning system of the type configured to have a particle collection container comprising sensing a pressure inside said electrographic process cleaning system proximate said particle collection container.

2. The process of claim 1, wherein said pressure is indicative of pressure inside said particle collection container.

3. The process of claim 1, wherein said pressure is indicative of an absence of said particle collection container.

4. A process for sensing leaks in a particle collection container that collects particles from an electrographic process comprising sensing a pressure indicative of pressure inside said particle collection container.

5. The process of claim 4, further comprising imposing a vacuum upon said particle collection container.

6. The process of claim 4, further comprising sensing the presence of a leak with a pressure sensor.

7. The process of claim 4, further comprising imposing a vacuum upon said particle collection container and terminating said vacuum upon sensing a leak in said particle collection container.

8. The process of claim 4, further comprising imposing a vacuum upon said particle collection container, wherein a sensed pressure inside a leaking particle collection container is related to a quantity of particles collected in said particle collection container, wherein said particles are drawn out of said particle collection container upon said quantity exceeding a critical quantity having a corresponding critical sensed pressure, and terminating said vacuum upon said sensed pressure being greater than that of a non-leaking particle collection container and less than said critical sensed pressure, thereby preventing said particles from being drawn out of said particle collection container.

9. The process of claim 4, wherein said particles include dry electrographic toner.

10. The process of claim 4, further comprising sensing an absence of said particle collection container.

11. An apparatus for removing particles from an electrographic process, comprising:

a particle separator;

a particle collection container in fluid communication with said particle separator;

a vacuum source in fluid communication with said particle separator; and, a pressure sensor in fluid communication with said particle collection container wherein said pressure sensor senses the presence of leaks in said particle collection container.

12. The apparatus of claim 11, wherein said pressure sensor senses a pressure inside said particle collection container.

13. The apparatus of claim 11, further comprising a conduit connecting said particle collection container and said particle separator, wherein said pressure sensor senses a pressure inside said conduit.

14. The apparatus of claim 11, further comprising a controller in communication with said pressure sensor, wherein a sensed pressure for a leaking particle collection container is related to a quantity of particles collected in said particle collection container, wherein said particles are drawn out of said particle collection container upon said quantity exceeding a critical quantity having a corresponding critical sensed pressure, and terminating said vacuum upon said sensed pressure being greater than that of a non-leaking particle collection container and less than said critical sensed pressure, thereby preventing said particles from being drawn out of said particle collection container.

15. The apparatus of claim 14, wherein said controller terminates vacuum to said particle collection container by terminating said vacuum source.

16. The apparatus of claim 11, further comprising pressure sensor support circuitry on a circuit board in proximity with said pressure sensor.

17. The apparatus of claim 11, wherein said pressure sensor comprises a wheatstone bridge.

18. The apparatus of claim 11, further comprising a pressure sensor conduit connecting said pressure sensor and said particle collection container.

19. The apparatus of claim 11, further comprising a conduit connecting said particle separator and said particle collection container, and a pressure sensor conduit connecting said pressure sensor to said conduit.

20. The apparatus of claim 11, wherein said particles include dry electrographic toner.

* * * * *